US007103989B2

(12) United States Patent
Rosseau et al.

(10) Patent No.: US 7,103,989 B2
(45) **Date of Patent: *Sep. 12, 2006**

(54) SPORTS EQUIPMENT CONDITIONING APPARATUS

(75) Inventors: James R. Rosseau, Birmingham, MI (US); Robert H. Rosseau, Inverness, IL (US)

(73) Assignee: ETC III LLC, Morton Glove, IL (US)

( * ) Notice: Subject to any disclaimer, the term of this patent is extended or adjusted under 35 U.S.C. 154(b) by 19 days.

This patent is subject to a terminal disclaimer.

(21) Appl. No.: 10/805,939

(22) Filed: Mar. 22, 2004

(65) Prior Publication Data

US 2005/0204579 A1 Sep. 22, 2005

(51) Int. Cl.
*F26B 25/00* (2006.01)
*F26B 7/00* (2006.01)
*A47F 7/00* (2006.01)

(52) U.S. Cl. ..... 34/104; 34/437; 34/440; 34/442; 34/103; 34/239

(58) Field of Classification Search ..... 34/437, 34/440, 441, 442, 104, 103, 106; 211/60.1, 211/85.7; D6/552, 512
See application file for complete search history.

(56) References Cited

U.S. PATENT DOCUMENTS 2,465,362 A * 3/1949 Elliott ..... 34/104
3,798,788 A 3/1974 Kuntz
5,377,849 A 1/1995 Martin
5,592,750 A 1/1997 Eichten
D394,926 S 6/1998 Lindsay
6,134,806 A 10/2000 Dhaemers
6,216,887 B1 4/2001 Soo
6,263,591 B1 7/2001 La Porte
6,553,687 B1 * 4/2003 Leamon, Jr. ..... 34/104
6,591,994 B1 7/2003 Bearss
6,880,711 B1 * 4/2005 Collier ..... 211/85.7
2002/0194746 A1 * 12/2002 Lancer ..... 34/90

* cited by examiner

*Primary Examiner*—Kenneth Rinehart
(74) *Attorney, Agent, or Firm*—Gardner Carton & Douglas LLP

(57) ABSTRACT

Disclosed is an apparatus for drying and conditioning sports equipment and apparel. A base contains an airflow generator, such as a motorized fan. Ambient temperature air is conveyed through a plurality of tubular members. Apertures in the tubular members allow for airflow to be conveyed to the surface of sports equipment or apparel. The sports equipment and apparel is maintained a distance from the apertures by pegs, pins or other support members. The base may contain a pad for conveying airflow with a fragrance or an antifungal agent.

59 Claims, 11 Drawing Sheets

SPORTS EQUIPMENT CONDITIONING APPARATUS

FIELD OF THE INVENTION

This invention relates generally to the field of sports equipment conditioning apparatus and more particularly to such an apparatus that stores, dries and deodorizes sports equipment.

BACKGROUND OF THE INVENTION

Protective pads, helmets, gloves, special footgear, colorful clothing and other apparel and equipment have become more popular (and more expensive) for a variety of sports. Proper care and conditioning of such equipment is important so that the equipment lasts longer and is comfortable and safe to wear. Soccer, hockey, football, lacrosse and even inline skating are examples of sports that typically require protective elbow pads, knee pads, shin pads, gloves, helmets, special footwear, and, in the case of hockey and inline skating, skates, which are frequently made of leather. Through use, such equipment becomes damp from sweat. When the equipment is used frequently, such as for daily practice and games, unless it is stored and conditioned properly, it does not dry between uses, but stays damp and becomes smelly and unsanitary. This problem is compounded during periods when, for example, the equipment is used for a tournament or training camp, in which it is typically used several times a day, perhaps for several days in a row.

Another problem, particularly for junior sports, is storage and organization of the equipment. Many sports involve traveling and transportation of the equipment. When packing the equipment, it is easy to overlook and omit one piece of equipment. However, in many sports, if a player does not have all the equipment, he or she cannot participate in the sport.

U.S. Pat. No. 5,592,750 to Eichten discloses a portable clothing and equipment dryer that can be stored in a suitcase-like container. Eichten teaches using a warm air blower to dry the clothes. U.S. Pat. No. 5,377,849 to Martin discloses a sports equipment rack for storing equipment.

Such prior art devices, however, have various drawbacks. The Martin device does not provide for drying or sanitation of the equipment. The Eichten device teaches drying with warm air, which tends to increase the smell and unsanitary aspect of damp, sweaty sports equipment and apparel. Eichten also teaches placing articles to be dried directly on conduit members, an arrangement that would tend to block the flow of air to the articles. The present invention addresses the deficiencies of the prior art designs in that it provides a sports equipment conditioner that simultaneously serves as a movable equipment storage rack, dryer, and deodorizer and also provides an antifungal feature that can be used for a wide variety of sizes and types of sports equipment.

BRIEF SUMMARY OF THE INVENTION

The present invention provides an apparatus for storing, drying, deodorizing and sanitizing sports equipment and apparel. In one embodiment, the apparatus of the present invention includes a plurality of tubular members that provide both support for the sports equipment and apertures through which air can pass to dry the equipment. According to one aspect of the present invention, the air used to dry the equipment is not heated but is merely conveyed to the equipment, which is maintained at a distance from the apertures in the tubular members. By avoiding the use of heat with the flowing air, the equipment will not smell, as would be the case with hot or warm air. According to another feature of the invention, the apparatus of the present invention can deliver a deodorizer and/or an antifungal agent together with the airflow. According to yet another feature of the invention, the apparatus of the present invention can deliver filtered air to the sports equipment stored on the apparatus by means of an air filter proximate to the airflow generator. Such features assist in sanitizing the equipment and reducing or eliminating an undesirable odor.

According to another feature of the present invention, the tubular members of the apparatus may be moved or rotated to more readily accommodate storage of sports equipment in a relatively confined space, such as a garage, closet or cargo area of a vehicle. In addition, the arrangement of tubular members may be changed—some members may be removed and others may be added—to form a different configuration of the apparatus to accommodate different equipment requirements for each sport.

In one embodiment of the present invention, the airflow is delivered to the sports equipment through apertures in the tubular members where the airflow is conveyed from an airflow generator, such as a fan, blowing air through a base tubular member which is hollow and is interconnected through other hollow tubular members. In another embodiment of the present invention, airflow is conveyed from an airflow generator, such as a fan, through an arrangement of hollow capillary tubes that extend from proximate the airflow generator to proximate the various pieces of sports equipment.

According to another feature of the present invention, the apertures in various tubular members may be selectively closed or opened, so that only those apertures needed are opened for which a piece of sports equipment is in place. According to yet another feature of the present invention, slidable gates are disposed on the top surface of the base to permit restriction of airflow to particular vertical tubular members, depending on the desired configuration. In another embodiment of the present invention, a support member is employed to maintain pieces of sports equipment at a distance from the surface of the tubular member so as to promote airflow between the surface of the tubular member and the piece of sports equipment. According to one embodiment, such a support member may be a curved plate with a plurality of apertures arranged in an offsetting configuration with respect to a plurality of apertures in the tubular member. The curved plate raises the sports equipment off the surface of the tubular member so as to allow airflow when in a raised position. When the curved plate is placed in the lowered position, the apertures in the tubular member are covered and the airflow is blocked. The curved plate would be maintained in the lowered position, without airflow, when, for example, a piece of sports equipment is not present at that particular position of the apparatus.

BRIEF DESCRIPTION OF THE DRAWINGS

The foregoing objects, features and advantages of the present invention will be readily understood when described below and illustrated in the accompanying drawings, in which:

FIG. 14A illustrates the "open" position and FIG. 14B illustrates the "closed" position;

DETAILED DESCRIPTION OF THE INVENTION

Figure 1:
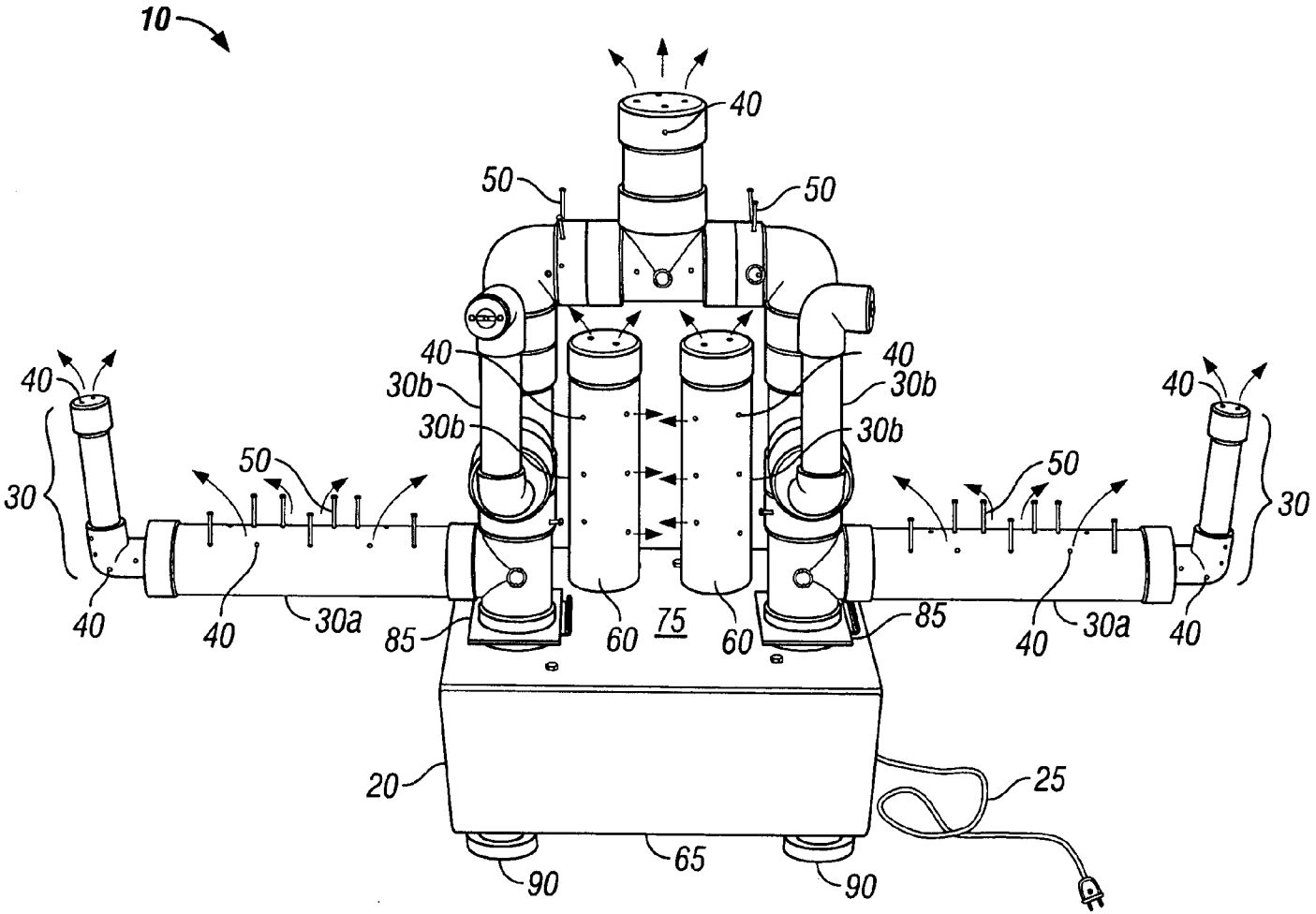
FIG. 1 illustrates a front perspective view of one embodiment of the apparatus of the present invention.

Turning first to FIG. 1, there is illustrated the sports equipment conditioning apparatus 10 of the present invention according to one embodiment. The apparatus 10 comprises a base 20 which contains an airflow generator, such as a motorized fan. Power to the airflow generator may be provided by a number of sources, one of which is illustrated, by way of example, as a power cord 25 that may be plugged into a conventional AC power source. Alternatively, the power source may be a battery, including, for example, an automobile battery source in the event the apparatus is used in a vehicle or in a location where a conventional AC power source is not available. In yet another alternative, the power source may be provided or supplemented by a solar power source consisting of conventional solar cells that supply electric power to the airflow generator or recharge a battery source. Mounted on the base 20 is an arrangement of interconnected tubular members 30 that serve to convey the airflow throughout the system as well as to provide support and storage for sports equipment and apparel. As will be apparent, the tubular members 30 may be configured in a variety of different ways, depending on the type and number of elements of the sports equipment.

In general, there are horizontally disposed tubular members 30*a* and vertically disposed tubular members 30*b*. In order to convey airflow to the surface of the sports equipment to be dried or conditioned, a plurality of apertures 40 are disposed in the tubular members 30 at locations where pieces of sports equipment will be positioned. In order to ensure that the airflow is effectively conveyed to the surface of the sports equipment, a plurality of pegs 50 or other support elements are provided which extend a distance above the surface of the tubular members 30 where the apertures 40 are located. Several of the tubular members 30 serve as airflow receiving members 60 and are mounted to and interconnected with the base 20 to receive the airflow into the tubular members 30 of the apparatus 10. Slidable gates 85 are disposed on the base 20 to cut off airflow to individual horizontal tubular members 30*a*, depending on the desired configuration of the tubular members 30 of the apparatus 10.

Figure 11:
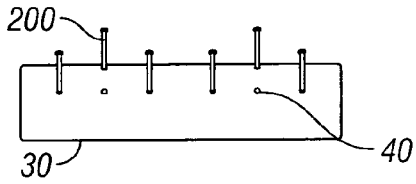
FIG. 11 illustrates an embodiment of the invention in which a plurality of pins or pegs are used to maintain the sports equipment at a distance from the apertures in the tubular member.
Figure 12:
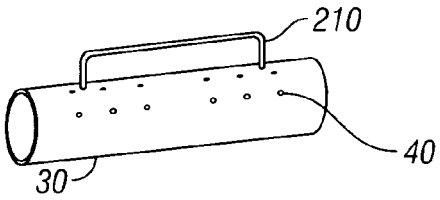
FIG. 12 illustrates an embodiment in which an elongated bar is used to maintain the sports equipment at a distance from the apertures in the tubular member.
Figure 13:
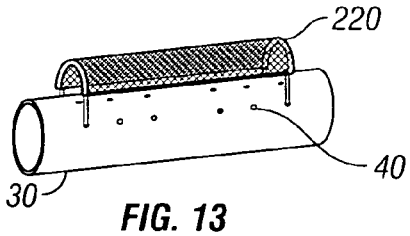
FIG. 13 illustrates an embodiment in which a screen support member is used to maintain the sports equipment at a distance from the apertures in the tubular member.
Figure 14A:
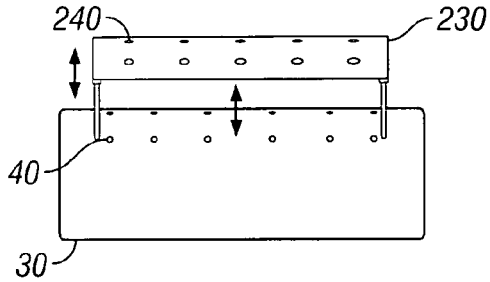
FIGS. 14A and 14B illustrate an embodiment in which a movable curved plate with apertures in an offsetting configuration with respect to the apertures in the tubular member is used to maintain the sports equipment at a distance from the apertures in the tubular member, where
Figure 14B:
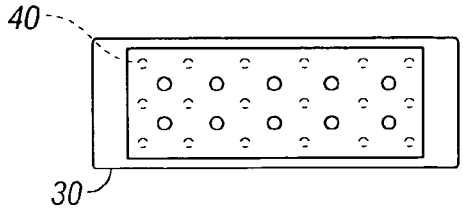

Turning for a moment to FIGS. 11–14, there are illustrated a variety of embodiments of the invention relating to support members that may maintain pieces of sports equipment at a distance from the apertures 40 in the tubular member 30. FIG. 11 illustrates an arrangement where a plurality of pins or pegs 200 extend at a distance above the apertures 40 of the tubular members 30. FIG. 12 illustrates a different arrangement in which an elongated bar 210 is attached to and extends above the apertures 40 of the tubular member 30. FIG. 13 illustrates another arrangement in which a screen 220 is disposed at a distance above the apertures 40 of the tubular member 30. In each of the arrangements illustrated in FIGS. 11–14, a support member is disposed such that it supports and maintains a piece of sports equipment at a distance above the apertures 40 of the tubular member 30. FIGS. 14A and 14B illustrate another embodiment in which a movable plate 230 is provided as a support member. The plate 230 is generally curved and has a contour similar to the contour of the outer surface of the tubular member 30 that includes the apertures 40. The curved plate 230 has a plurality of apertures 240 which are positioned such that they are in an offsetting configuration with respect to the apertures 40 of the tubular member 30. The curved plate 230 may move between an upper "open" position and a lower "closed" position. In the upper "open" position, the airflow from the tubular member 30 passes from the apertures 40 through the apertures 240 and to the sports equipment. In the lower "closed" position, the solid portion of the curved plate 230 interferes with the apertures 40 of the tubular member 30, and the apertures 240 of the curved plate 230 interfere with the solid portion of the tubular member. In other words, when the curved plate 230 is maintained in the lowered "closed" position, the flow of air is blocked.

Figure 10:
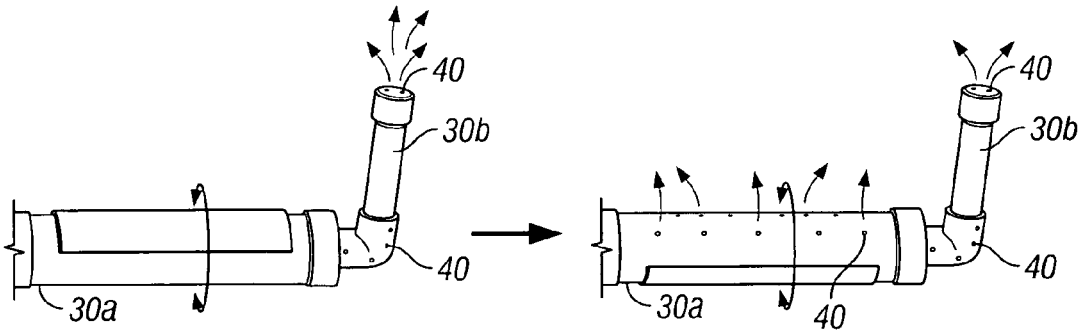
FIG. 10 shows a rotatable sleeve as part of the various tubular members with airflow apertures. The rotatable sleeve may be manually adjusted to cover the apertures of tubular member segments that are not used.

Another alternative embodiment of the invention is illustrated in FIG. 10 in which various tubular members 30 with airflow apertures 40 include a rotatable sleeve 130 that may be manually adjusted to cover the apertures 40 of tubular member segments 30 that are not used. If several of the airflow apertures 40 are covered, the airflow rate may be adjusted with the control panel 100 so that the uniformity and consistency of the airflow is maintained at a particular desired rate or within a desired range.

Referring back to FIG. 1, the size, number, and location of the apertures 40 will vary depending upon configuration of the tubular members 30 which, in turn, will vary depending upon the type of sports equipment. In general, the apertures 40 should extend substantially throughout and proximate to the surface area of the sports equipment. In this manner, the flowing air may be conveyed to a substantial portion of the surface of the sports equipment to effect drying and conditioning of the equipment.

Figure 2:
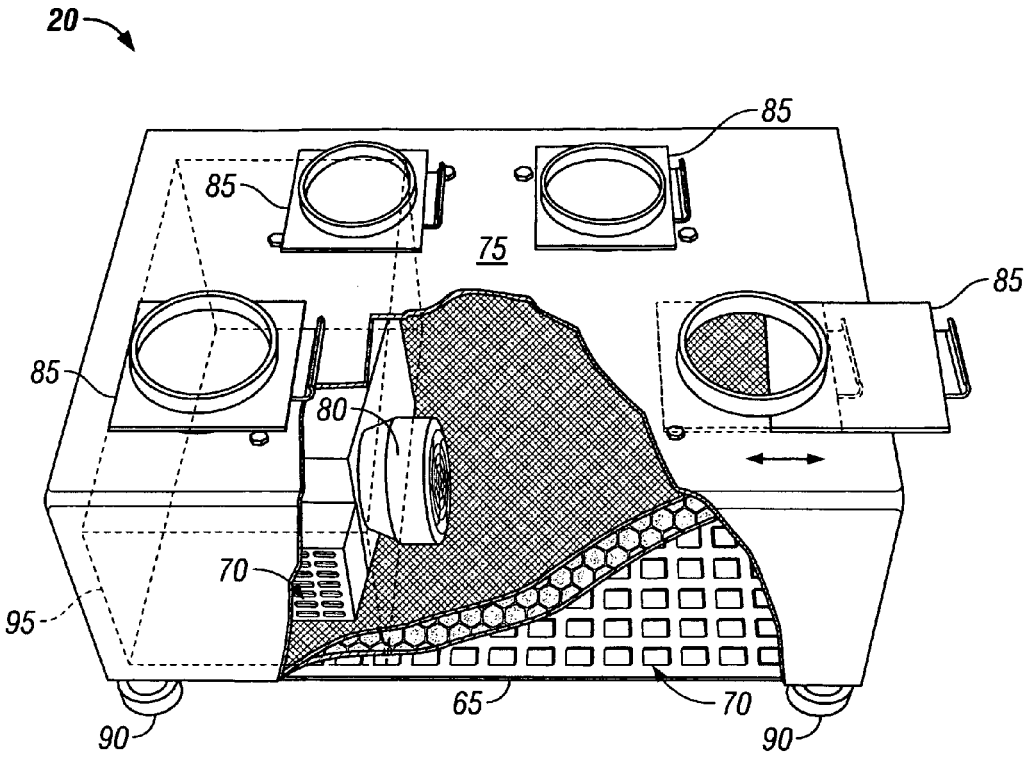
FIG. 2 depicts a cutaway view of the base unit showing the motorized fan mechanism of the apparatus of FIG. 1, as well as alternate forms of the plurality of rollers and feet on the bottom surface of the base.
Figure 2A:
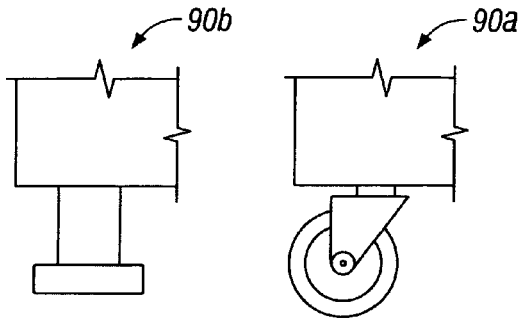

Turning to FIG. 2, there is illustrated a cutaway portion of the base 20 of the apparatus 10 of the present invention. According to this particular embodiment of the invention, the base 20 is generally rectangular in shape. The bottom surface 65 of the base contains a plurality of air intake vents 70 that serve to supply air to an air generator such as a motorized fan 80, as illustrated. When activated, the fan 80 draws air from the intake vents 70 and conveys the flowing air upwards into the airflow receiving members 60 attached to the top of the base 20. A plurality of rollers 90 are provided on the bottom surface 65 of the base 20 so that the intake vents 70 are not blocked by the ground or surface upon which the apparatus 10 rests. The rollers 90 are illustrated merely by way of example and could take a number of alternative forms, such as castors 90*a* or even stationary feet 90*b* that provide spacing from the ground to allow air to flow in from the intake vents 70. According to an alternative arrangement, the air generator 80 may be mounted on the side of the base 20, and the intake vents 70 may likewise be disposed on the side of the housing. In this arrangement, the apparatus 10 could sit flat on the floor or other surface because the intake vents 70 are located on the side.

According to an important aspect of the present invention, the airflow generator 80 will preferably convey unheated air throughout the system and onto the surfaces of the sports equipment. While unheated air may take longer to dry the sports equipment, it generally results in drying of the equipment in such a way that any odor from the sweat or moisture on the equipment is reduced. Moreover, heated air would likely contribute not only to an undesirable odor, but to an unsanitary condition of the sports equipment and apparel.

Figure 3:
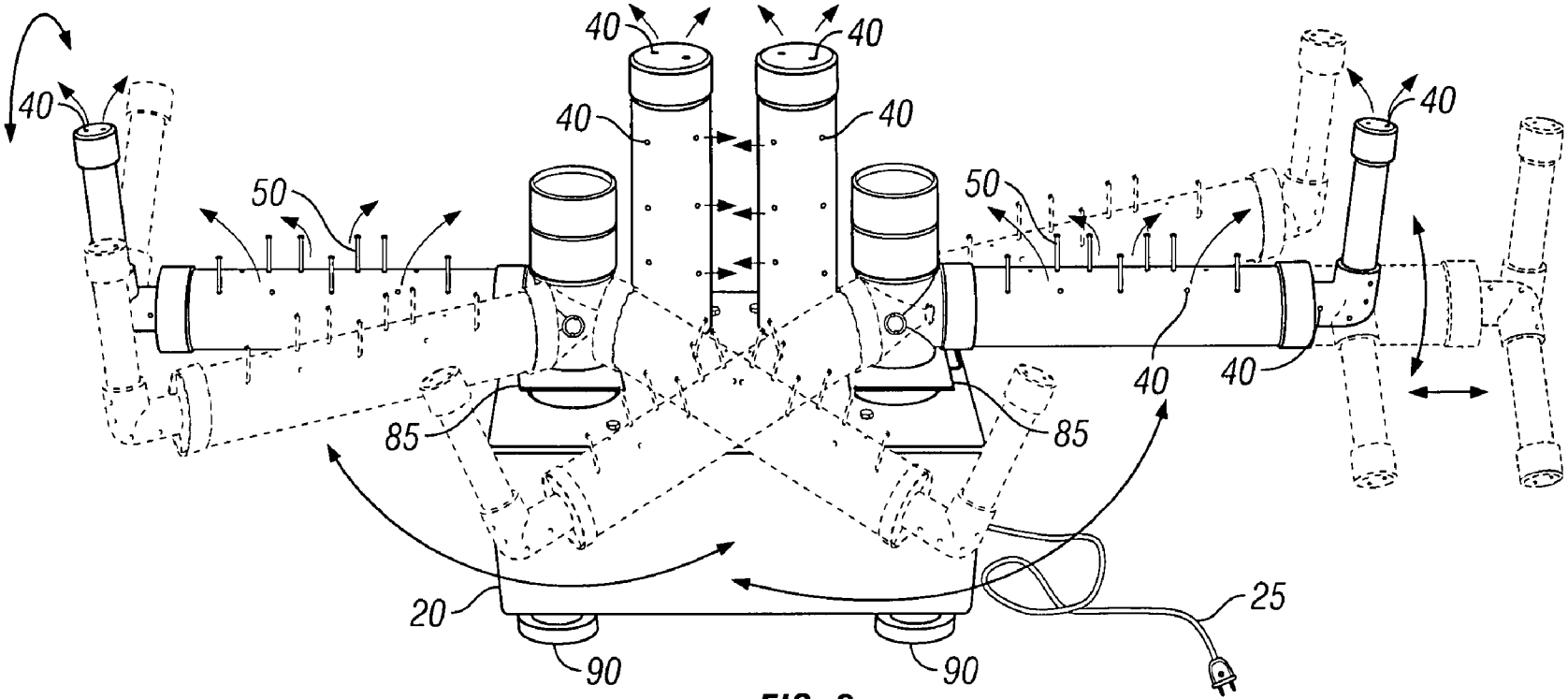
FIG. 3 illustrates the rotation of some of the tubular members of the apparatus of the present invention to accommodate a wide variety of equipment and space constraints.

In accordance with another feature of the present invention, FIG. 3 illustrates a feature of the present invention in which the tubular members 30 may be rotated so as to allow the apparatus 10 to conform to a particular location, such as a portion of a garage, a closet or the cargo space of a vehicle. As illustrated by the solid and broken line representations of the various tubular members 30 along with the curved, double-headed arrows depicting movement, the horizontal tubular members 30*a* may be rotated in a horizontal plane, and the vertical tubular members 30*b* may be rotated in a generally vertical plane. As should be evident, the tubular members 30 may also be constructed so that they could be collapsed, i.e., shortened, or lengthened, depending on the space to which the apparatus 10 must conform or the size and shape of the sports equipment that the apparatus 10 accommodates. In other words, the position and length of the tubular members 30 of the present invention may be adjusted to conform to the space available or desired for the apparatus 10 or to conform to the dimensions of particular items of sports equipment or apparel.

Figure 4:
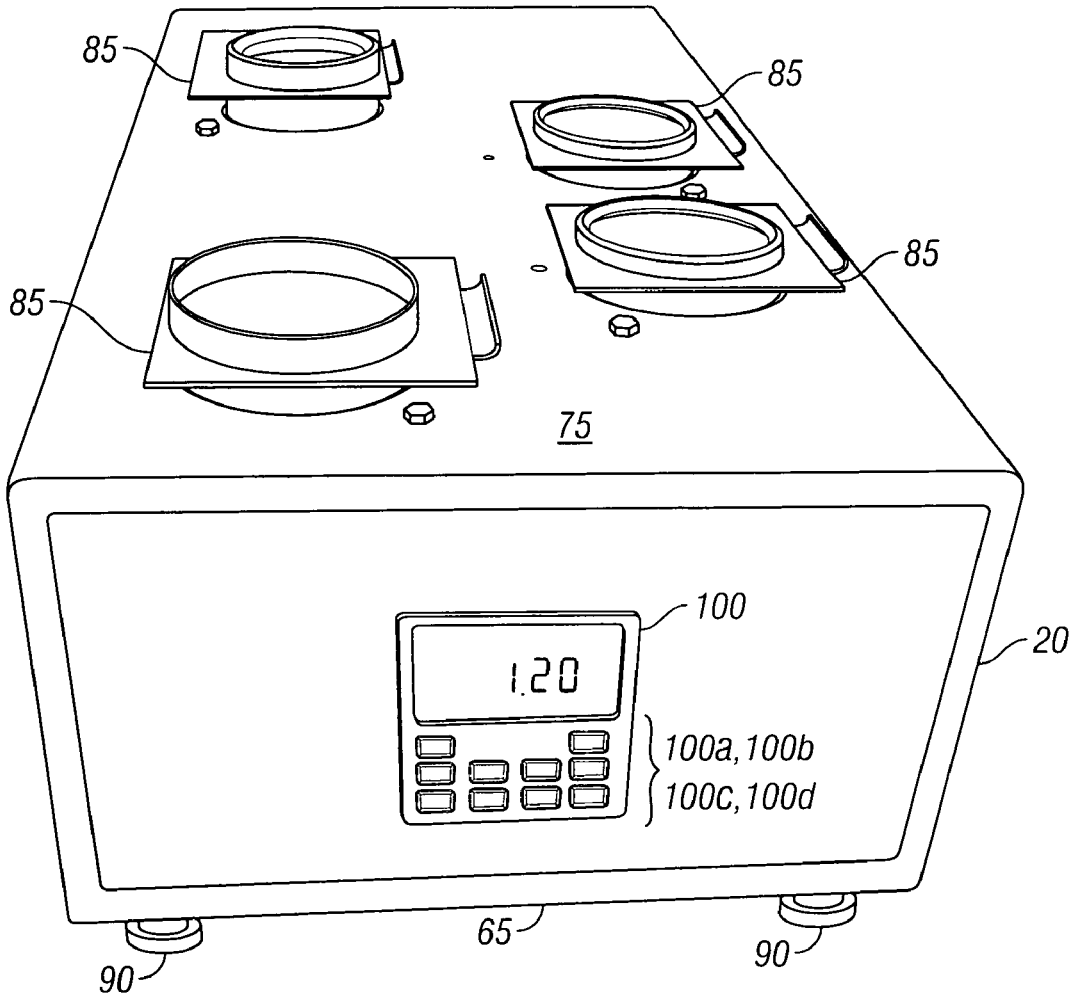
FIG. 4 illustrates a control panel located on the base of the apparatus and shows slidable gates that shut off airflow to individual vertical tubular members.

Turning to FIG. 4, there is illustrated an electronic control panel 100 for the airflow generator 80 of the present invention. Preferably, the control panel 100 will include at least a timer 100*a* so that the air generator 80 may be activated and will automatically turn off at a later time, depending upon the setting of the control panel 100. As should be evident, the control panel 100 may also include a variety of other settings and features, such as a moisture control 100*b*, which terminates operation when items are sensed to be dry, and a variable fan control 100*c*. As an alternative to an electronic control panel 100, the apparatus of the present invention may also be provided with a simple on-off switch 100*d* that can be manually activated. As another alternative, such a simple on-off switch 100*d* can also include a timer that will automatically shut off the airflow generator 80 after a predetermined period.

The size and flow volume capacity of the fan or blower 80 should be adequate to properly dry equipment in a timely fashion. The size and quantity of the apertures 40 are in direct proportion to the size of the fan or blower 80 that is used. An ionized air source 95 (FIG. 2) may also be used.

Figure 5:
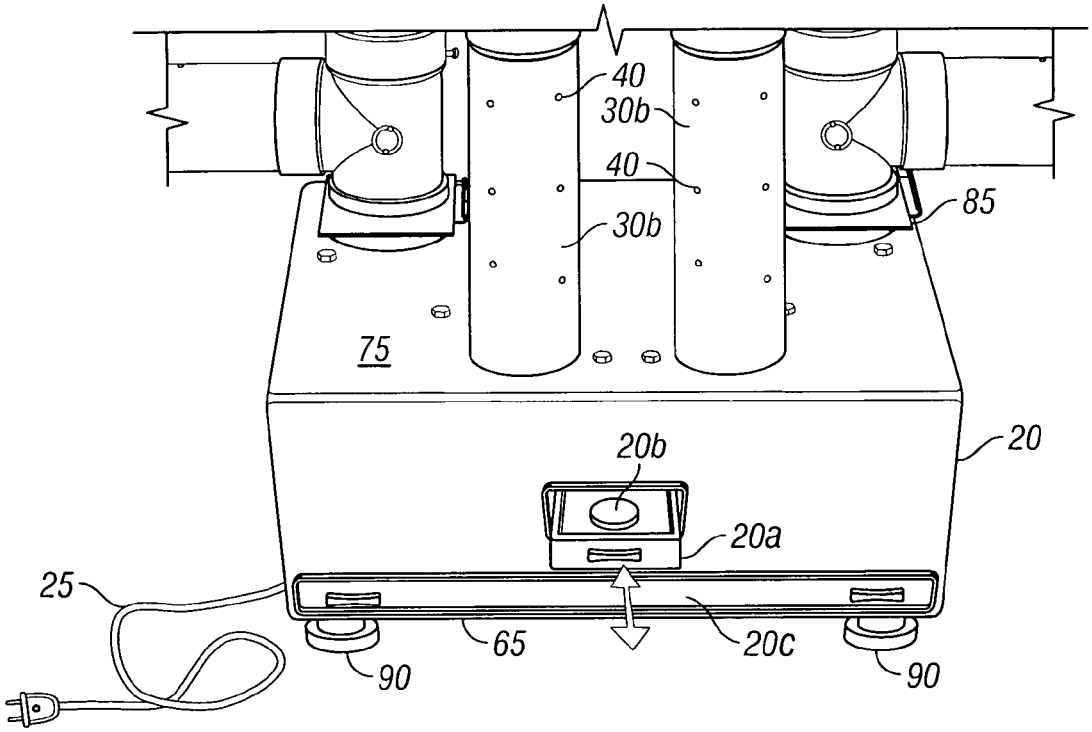
FIG. 5 shows on the base unit a tray in which a deodorizing, antifungal or ozone tablet or pad or electric ozone generator may be placed, as well as another tray in which an air filter may be placed.

Turning to FIG. 5, there is illustrated a slidable tray 20*a* that may be disposed on the side of the base 20 of the apparatus 10 to accommodate a pad, patch or tablet 20*b*. Such a pad, patch or tablet 20*b* may be impregnated with a fragrance, deodorizer or antifungal agent that would be conveyed with the airflow through the tubular members 30 and onto the surface of the sports equipment. Thus, such a pad 20*b* may assist with deodorizing or reducing potential fungus on the sports equipment or apparel. FIG. 5 also illustrates a second slidable tray 20*c* that may be disposed on the side of the base 20 of the apparatus 10. This second tray 20*c* may accommodate a filter to filter the airflow delivered through the tubular members 30 to the apertures 40 of the apparatus 10. This filter may assist with providing clean, particle-free air to dry and condition pieces of sports equipment stored on the apparatus 10.

Figure 6:
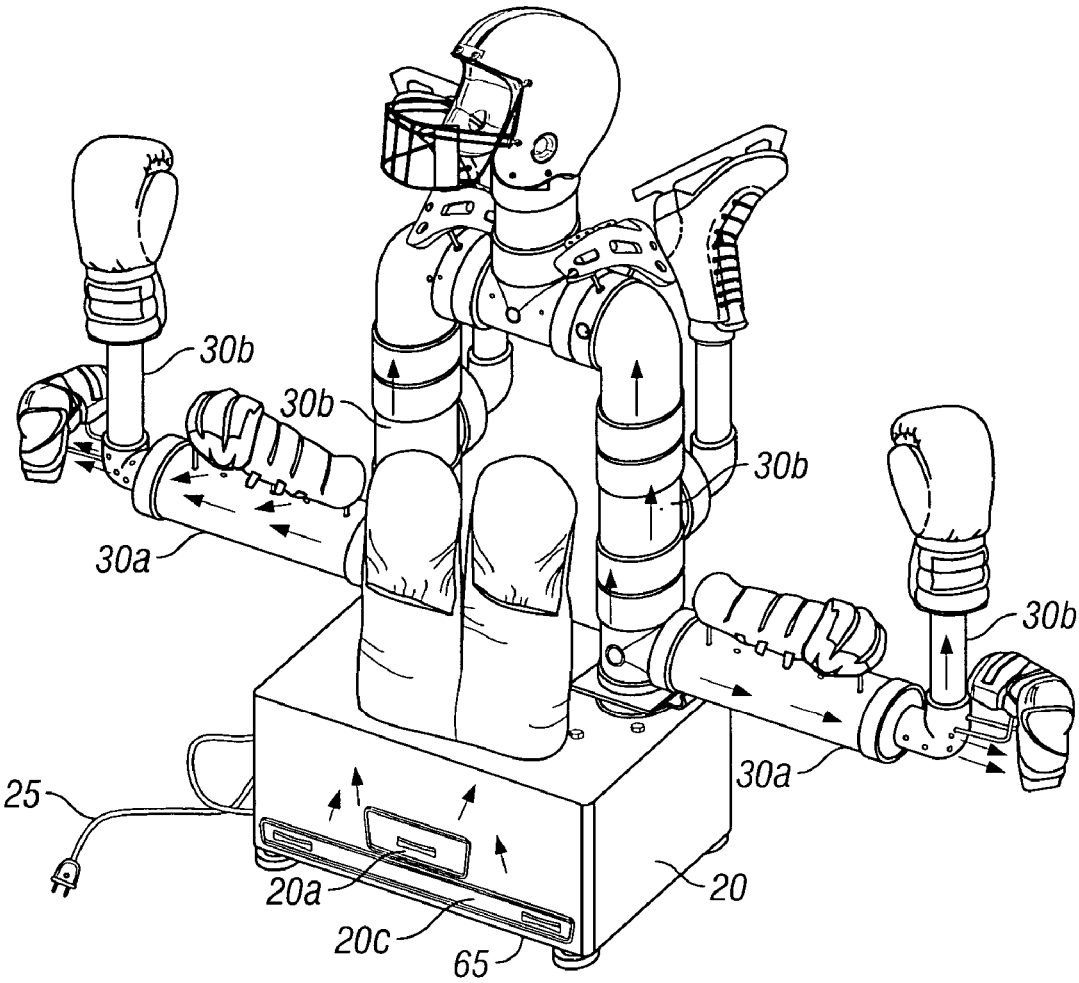
FIG. 6 illustrates one particular configuration of the tubular members of the apparatus of the present invention and illustrates the airflow in relation to sports equipment stored on the apparatus.

Turning now to FIG. 6, there is illustrated the airflow through one embodiment of the apparatus 10 of the present invention, as well as the arrangement of various items of sports equipment and apparel with which the apparatus 10 of the present invention is used. In particular, the airflow begins with the airflow generator 80 in the base 20 and is conveyed upward through a plurality of airflow receiving tubular members 60. In the illustrated embodiment there are four generally vertically extending airflow receiving tubular members 60. Two of the airflow-receiving tubular members 60 include respective horizontally extending tubular members 30*a* that further each include an additional vertically extending tubular member 30*b* segment. By way of example, two of the horizontally extending tubular members 30*a* may each accommodate a shin guard and an elbow pad, while the additional vertically extending tubular member 30*b* segments may each accommodate a skate, an item of footwear, or boot. Two of the vertically extending airflow receiving tubular members 60 may be arranged to be joined in a generally square upside-down U-shaped manner that provides two additional generally horizontal tubular segments 30*a* which can accommodate shoulder pads and one central vertically extending member 30*b* that can accommodate a helmet, hat, or face mask. As previously described, according to a preferred aspect of the invention, the tubular members 30, in the location of the airflow apertures 40, include support members 50, such as pins, pegs, or rails, that maintain the sports equipment or apparel at a distance from the apertures 40. In this manner, the airflow conveyed from the airflow generator 80 may be more effectively conveyed to the surface of the sports equipment or apparel for drying or conditioning.

Figure 7:
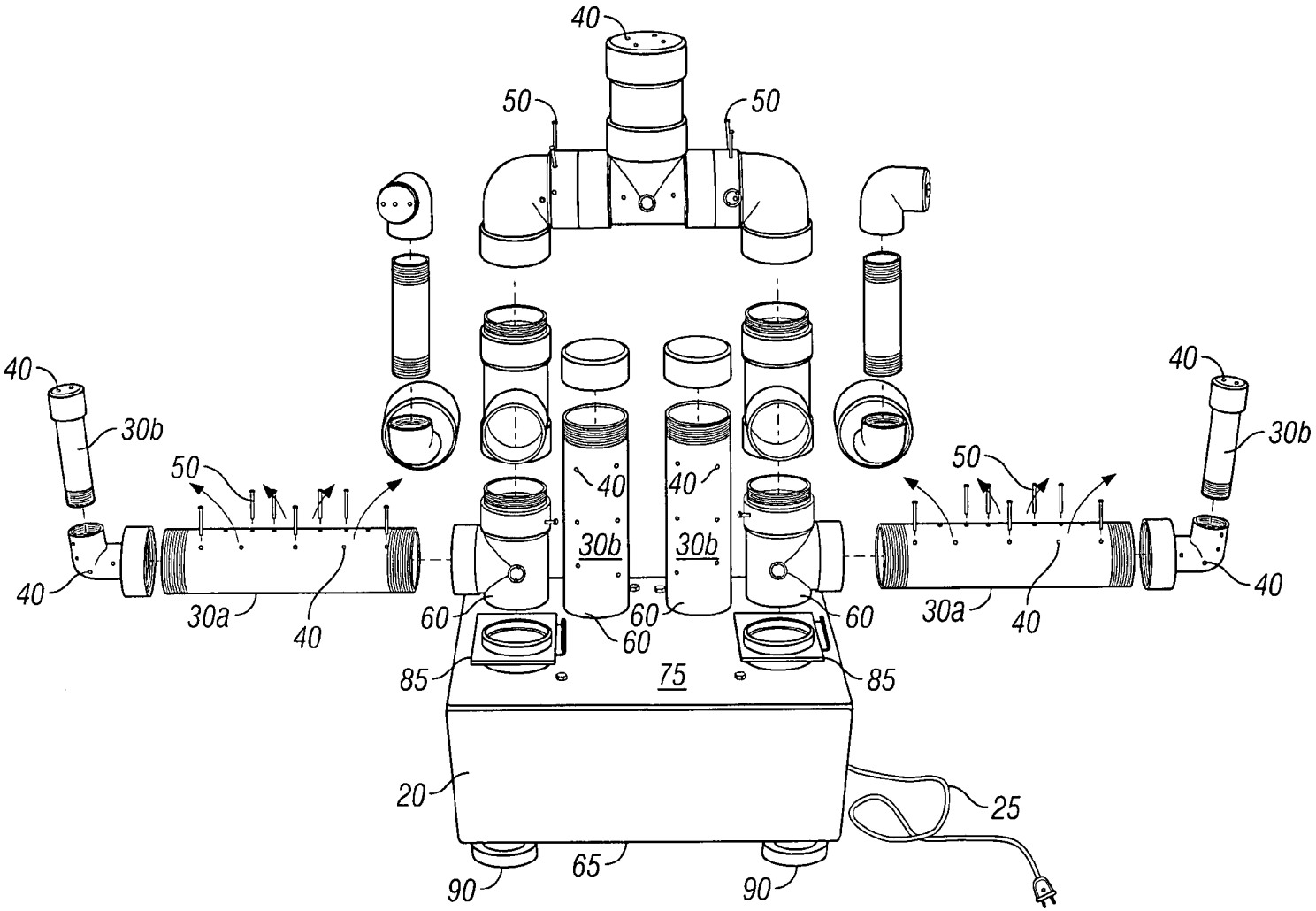
FIG. 7 shows, according to one potential embodiment, the assembly of the tubular members of the apparatus of the present invention and illustrates that individual tubular members may be removed and replaced with a cap, depending on the desired configuration of the apparatus.

Turning to FIG. 7, there is illustrated one embodiment of the present invention partially disassembled. As can be seen, the tubular members 30 of the present invention may be relatively conventional PVC tubing, and the various tubular members 30 may be interconnected with threaded connections. Elbows may be used to interconnect a horizontal member 30*a* to a vertical member 30*b*. With this approach, the elements of the apparatus 10 of the present invention may be more readily repaired or replaced with relatively conventional PVC tubing components. In addition, elements of the apparatus 10 of the present invention may be removed and replaced with a cap, depending on the desired configuration. However, according to a different embodiment of the present invention, the tubular members 30 of the apparatus 10 may be fabricated from a single molded plastic arrangement. In either arrangement, the plastic tubing is preferred because it is relatively lightweight and inexpensive.

Figure 8:
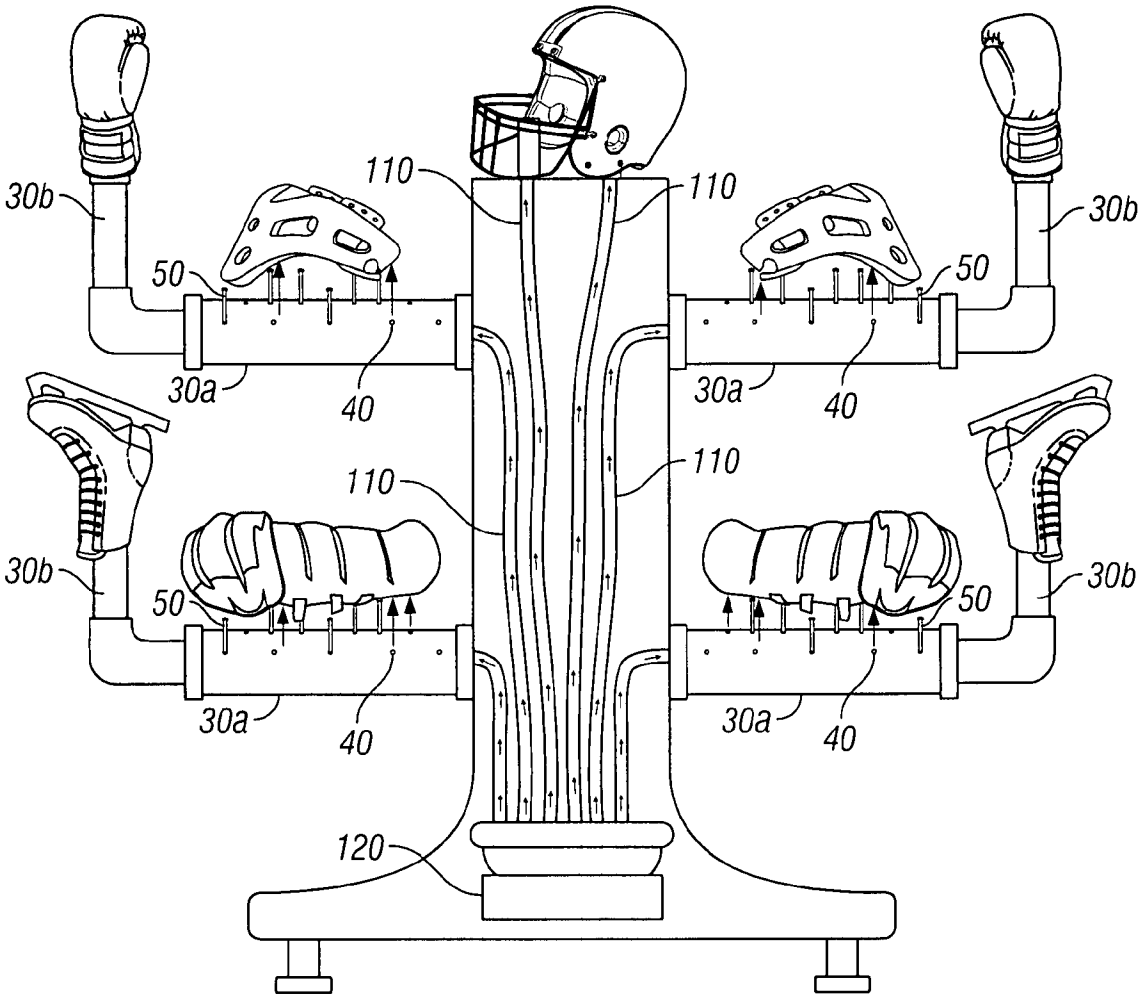
FIG. 8 shows an alternative embodiment of the apparatus of the present invention in which the airflow is delivered to various tubular members from a system of capillary tubes, with sports equipment stored on the tubular members of the apparatus.
Figure 9:
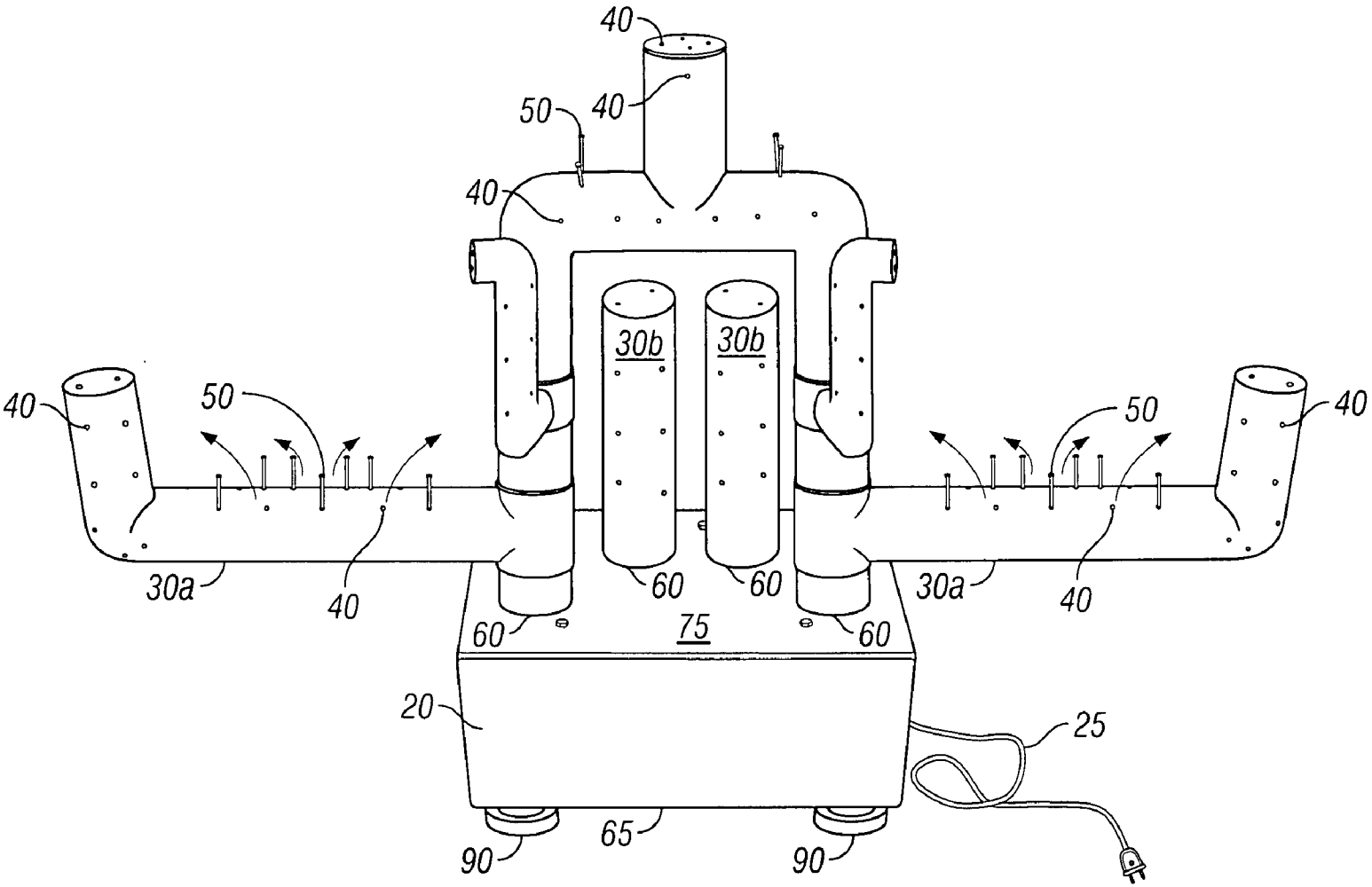
FIG. 9 shows the present invention with tubular members fabricated from a single molded arrangement, illustrating airflow from the apertures in the tubular members.

As illustrated in connection with the embodiment of FIG. 6, the tubular members 30 are generally hollow so as to allow the airflow to be conveyed through the tubular members 30 and out of the array of apertures 40 in the tubular members 30. However, an alternative arrangement is illustrated in FIG. 8, in which a plurality of capillary tubes 110 extends from an airflow generator 80. As illustrated, the plurality of capillary tubes 110 may be used to convey the airflow from the airflow generator 80 to the plurality of horizontally and vertically extending tubular members 30*a, b*. As a further alternative, a greater plurality of capillary tubes 110 could be arranged to convey airflow from the airflow generator 80 to particular apertures 40 in the tubular members 30. As another alternative arrangement, a capillary tube control apparatus 120 may be disposed between the airflow generator 80 and the individual capillary tubes 110. In such an arrangement, the capillary tube control apparatus 120 may selectively enable or disable particular capillary tubes 110, which in turn selectively enable or disable the airflow at the associated apertures 40 in the tubular members 30. As a further enhancement of this arrangement, a more sophisticated control panel 100 may be provided, perhaps with a graphic display of the various elements of sports equipment, so that various segments of the tubular members 30 may be activated or deactivated, depending upon whether an element of sports equipment is disposed on that segment. One further aspect of such a control apparatus 100 may preferably be the ability to adjust the speed and/or volume of the airflow generator 80 in relation to the number of apertures 40 that are activated. As a result, the apparatus 10 of the invention can ensure uniformity and consistency of the airflow at a desired rate or within a desired range.

Figure 15:
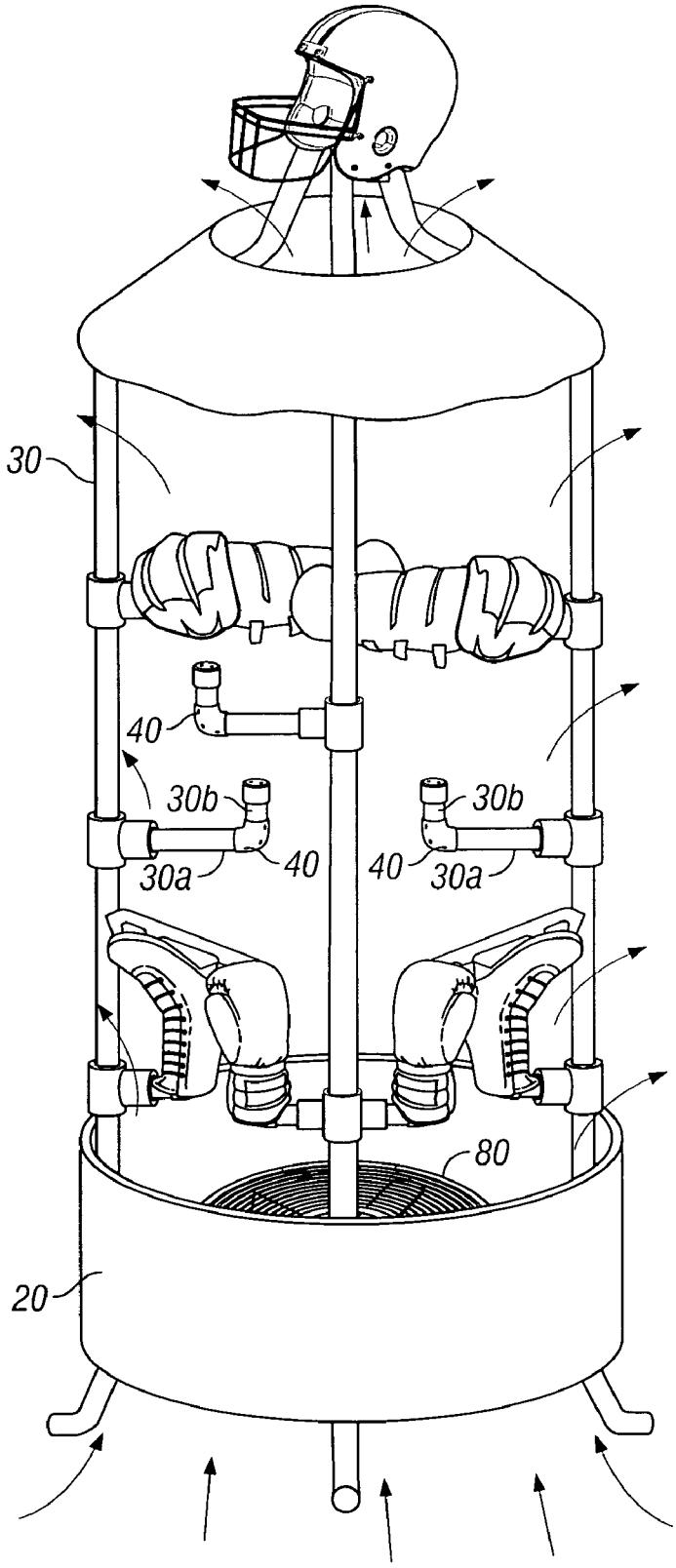
FIG. 15 shows an alternative embodiment of the invention in which a plurality of pieces of sports equipment are disposed within a cylindrical chamber within which airflow is generated.

Finally, turning to FIG. 15, there is illustrated an alternative embodiment of the present invention in which a plurality of pieces of sports equipment are disposed within a cylindrical chamber within which airflow is generated. This embodiment has an open base 20 with airflow delivered to the apertures 40 in the tubular members 30 and from the air generator 80 over all pieces of sports equipment stored on the tubular members 30.

What is claimed is:

1. An apparatus for conditioning sports equipment and apparel, the apparatus comprising:

a plurality of generally hollow tubular members with at least one section having a plurality of apertures;

an airflow generator for generating an ambient temperature airflow through the tubular members and out of the apertures;

at least one support member located proximate the apertures for maintaining a piece of sports equipment or apparel at a predetermined distance from the apertures; and a means for selectively closing or opening the apertures.

2. The apparatus of claim 1 further comprising a fragrance generator that provides a fragrance to the airflow conveyed through the tubular members.

3. The apparatus of claim 1 further comprising an antifungal agent generator that provides an antifungal agent that is conveyed through the tubular members.

4. The apparatus of claim 1 further comprising a filtration system for the air that is conveyed through the tubular members.

5. The apparatus of claim 1 wherein the plurality of tubular members includes at least one generally horizontally disposed tubular member and at least one generally vertically disposed tubular member.

6. The apparatus of claim 1 further comprising a source of ambient temperature air that is supplied to the airflow generator.

7. The apparatus of claim 1 wherein the airflow generator is a motorized fan.

8. The apparatus of claim 1 wherein the tubular members are hollow PVC.

9. The apparatus of claim 1 wherein apertures are provided to accommodate a piece of sports equipment or apparel selected from the group comprising a skate, a boot, footwear, a glove, a helmet, a shin guard, and elbow guard, pants, or a jersey, shoulder pads, and hip pads.

10. The apparatus of claim 1 further including a control panel for controlling the activation and operation of the airflow generator.

11. The apparatus of claim 1 wherein the airflow generator allows for variable and constant speeds.

12. An apparatus for conditioning sports equipment and apparel, the apparatus comprising:

a plurality of generally hollow tubular members with at least one section having a plurality of apertures;

an airflow generator for generating an ambient temperature airflow through the tubular members and out of the apertures; and at least one support member located proximate the apertures for maintaining a piece of sports equipment or apparel at a predetermined distance from the apertures, wherein the tubular members may be rotated within a range of positions.

13. The apparatus of claim 12 further comprising a fragrance generator that provides a fragrance to the airflow conveyed through the tubular members.

14. The apparatus of claim 12 further comprising an antifungal agent generator that provides an antifungal agent that is conveyed through the tubular members.

15. The apparatus of claim 12 further comprising a filtration system for the air that is conveyed through the tubular members.

16. The apparatus of claim 12 wherein the plurality of tubular members includes at least one generally horizontally disposed tubular member and at least one generally vertically disposed tubular member.

17. The apparatus of claim 12 further comprising a source of ambient temperature air that is supplied to the airflow generator.

18. The apparatus of claim 12 wherein the airflow generator is a motorized fan.

19. The apparatus of claim 12 wherein the tubular members are hollow PVC.

20. The apparatus of claim 12 wherein apertures are provided to accommodate a piece of sports equipment or apparel selected from the group comprising a skate, a boot, footwear, a glove, a helmet, a shin guard, and elbow guard, pants, or a jersey, shoulder pads, and hip pads.

21. The apparatus of claim 12 further including a control panel for controlling the activation and operation of the airflow generator.

22. The apparatus of claim 12 wherein the airflow generator allows for variable and constant speeds.

23. An apparatus for conditioning sports equipment and apparel, the apparatus comprising:

a plurality of generally hollow tubular members with at least one section having a plurality of apertures;

an airflow generator for generating an ambient temperature airflow through the tubular members and out of the apertures; and at least one support member located proximate the apertures for maintaining a piece of sports equipment or apparel at a predetermined distance from the apertures, wherein a curved device with offsetting apertures raises equipment off the surface of the tubular member so as to allow airflow through the apertures in the tubular members when in the raised position, and covers the apertures in the tubular members when in the lowered position to block airflow.

24. The apparatus of claim 23 further comprising a fragrance generator that provides a fragrance to the airflow conveyed through the tubular members.

25. The apparatus of claim 23 further comprising an antifungal agent generator that provides an antifungal agent that is conveyed through the tubular members.

26. The apparatus of claim 23 further comprising a filtration system for the air that is conveyed through the tubular members.

27. The apparatus of claim 23 wherein the plurality of tubular members includes at least one generally horizontally disposed tubular member and at least one generally vertically disposed tubular member.

28. The apparatus of claim 23 further comprising a source of ambient temperature air that is supplied to the airflow generator.

29. The apparatus of claim 23 wherein the airflow generator is a motorized fan.

30. The apparatus of claim 23 wherein the tubular members are hollow PVC.

31. The apparatus of claim 23 wherein apertures are provided to accommodate a piece of sports equipment or apparel selected from the group comprising a skate, a boot, footwear, a glove, a helmet, a shin guard, and elbow guard, pants, or a jersey, shoulder pads, and hip pads.

32. The apparatus of claim 23 further including a control panel for controlling the activation and operation of the airflow generator.

33. The apparatus of claim 23 wherein the airflow generator allows for variable and constant speeds.

34. An apparatus for conditioning sports equipment and apparel, the apparatus comprising:

a substantially enclosed base having a plurality of air intake vents and including a variable/constant speed airflow generator;

a plurality of generally hollow tubular members for supporting sports equipment and apparel, at least one tubular member of the plurality being attached to the base and receiving a flow of air from the airflow generator; and at least one area on the plurality of generally hollow tubular members that includes a plurality of apertures and at least one support member configured to maintain a piece of sports equipment at a predetermined distance from the plurality of apertures, wherein the airflow generator further includes a means for conveying a flow of ionized air.

35. The apparatus of claim 34 wherein the airflow generator further includes a means for conveying a flow of air impregnated with a fragrance.

36. The apparatus of claim 34 wherein the airflow generator further includes a means for conveying a flow of air impregnated with an antifungal agent.

37. The apparatus of claim 34 further comprising a filtration system for the air that is conveyed through the tubular members.

38. The apparatus of claim 34 wherein the airflow generator is a motorized fan.

39. The apparatus of claim 34 further comprising an electronic control panel that can regulate the airflow rate and the operation of the airflow generator.

40. The apparatus of claim 39 wherein the electronic control panel includes a timer function for operating the motorized fan for a predetermined period of time.

41. The apparatus of claim 34 wherein the tubular members are hollow PVC.

42. An apparatus for conditioning sports equipment and apparel, the apparatus comprising:

a substantially enclosed base having a plurality of air intake vents and including a variable/constant speed airflow generator;

a plurality of generally hollow tubular members for supporting sports equipment and apparel, at least one tubular member of the plurality being attached to the base and receiving a flow of air from the airflow generator; and at least one area on the plurality of generally hollow tubular members that includes a plurality of apertures and at least one support member configured to maintain a piece of sports equipment at a predetermined distance from the plurality of apertures, wherein slidable gates are disposed on the top surface of the base to regulate airflow to the tubular members.

43. The apparatus of claim 42 wherein the airflow generator further includes a means for conveying a flow of air impregnated with a fragrance.

44. The apparatus of claim 42 wherein the airflow generator further includes a means for conveying a flow of air impregnated with an antifungal agent.

45. The apparatus of claim 42 further comprising a filtration system for the air that is conveyed through the tubular members.

46. The apparatus of claim 42 wherein the airflow generator is a motorized fan.

47. The apparatus of claim 42 further comprising an electronic control panel that can regulate the airflow rate and the operation of the airflow generator.

48. The apparatus of claim 42 wherein the electronic control panel includes a timer function for operating the motorized fan for a predetermined period of time.

49. The apparatus of claim 42 wherein the tubular members are hollow PVC.

50. An apparatus for conditioning sports equipment and apparel comprising:

a substantially enclosed base having a plurality of air intake vents and including an airflow generator, a plurality of tubular members for supporting sports equipment and apparel, at least one of which is attached to the base, at least one area on the tubular members that includes a plurality of apertures and at least one support member maintaining a piece of sports equipment at a predetermined distance from the apertures and allowing a flow of air to be conveyed to the surface of the sports equipment, a plurality of capillary tubes that receive airflow from the airflow generator and convey the airflow to each piece of sports equipment stored on the tubular members.

51. The apparatus of claim 50 wherein the airflow generator further includes a means for conveying a flow of air impregnated with a fragrance.

52. The apparatus of claim 50 wherein the airflow generator further includes a means for conveying a flow of air impregnated with an anti-fungal agent.

53. The apparatus of claim 50 wherein the airflow generator further includes a means for conveying a flow of ionized air.

54. The apparatus of claim 50 further comprising a filtration system for the air that is conveyed through the tubular members.

55. The apparatus of claim 50 wherein the airflow generator is a motorized fan.

56. The apparatus of claim 50 further comprising an electronic control panel that can regulate the airflow rate and the operation of the airflow generator.

57. The apparatus of claim 56 wherein the electronic control panel includes a timer function for operating the motorized fan for a predetermined period of time.

58. The apparatus of claim 50 wherein the airflow generator allows for variable or constant speed.

59. The apparatus of claim 50 wherein the tubular members are hollow PVC.

* * * * *

UNITED STATES PATENT AND TRADEMARK OFFICE

CERTIFICATE OF CORRECTION

PATENT NO. : 7,103,989 B2
APPLICATION NO. : 10/805939
DATED : September 12, 2006
INVENTOR(S) : James R. Rosseau and Robert H. Rosseau It is certified that error appears in the above-identified patent and that said Letters Patent is hereby corrected as shown below:

ON THE TITLE PAGE:

In Item (*), delete "This patent is subject to a terminal disclaimer"

IN THE CLAIMS:

Column 10, line 61, change "claim 42" to -- claim 47 --.

Signed and Sealed this

Nineteenth Day of December, 2006

JON W. DUDAS
*Director of the United States Patent and Trademark Office*